US010080699B2

(12) United States Patent
Schraudolph et al.

(10) Patent No.: US 10,080,699 B2
(45) Date of Patent: Sep. 25, 2018

(54) SEAT DEVICE AND ASSISTIVE WALKER DEVICE COMPRISING THE SEAT DEVICE

(71) Applicant: XENTIQ PARTNERS (PTE.) LTD., Singapore (SG)

(72) Inventors: Ulrich Schraudolph, Singapore (SG); Pascal Yun Fo Yee Chong San, Singapore (SG); Zhenglong Donn Koh, Singapore (SG); Ching Chiuan Yen, Singapore (SG)

(73) Assignee: XENTIQ PARTNERS (PTE.) LTD., Singapore (SG)

( * ) Notice: Subject to any disclaimer, the term of this patent is extended or adjusted under 35 U.S.C. 154(b) by 418 days.

(21) Appl. No.: 15/067,044

(22) Filed: Mar. 10, 2016

(65) Prior Publication Data

US 2016/0296409 A1 Oct. 13, 2016

(30) Foreign Application Priority Data

Apr. 10, 2015 (SG) ..... 10201502867Q

(51) Int. Cl.
*A61H 3/04* (2006.01)

(52) U.S. Cl.
CPC ..... *A61H 3/04* (2013.01); *A61H 2201/0161* (2013.01); *A61H 2201/0165* (2013.01)

(58) Field of Classification Search
CPC ..... A61H 3/04
(Continued)

(56) References Cited

U.S. PATENT DOCUMENTS 1,104,615 A * 7/1914 Braden ..... A47C 7/56 297/332
4,162,101 A * 7/1979 McCague, Sr. ..... A45B 5/00 135/67

(Continued)

FOREIGN PATENT DOCUMENTS

DE 825324 C 12/1951
DE 1005393 B 3/1957

(Continued)

*Primary Examiner* — Anthony D Barfield
(74) *Attorney, Agent, or Firm* — Hultquist, PLLC; Steven J. Hultquist

(57) ABSTRACT

A seat device is provided, comprising: a frame, a seat platform which is hinged to the frame so as to be pivotable between a completely folded position and a completely unfolded position, in which a user is allowed to seat thereon, and a spring mechanism with a variable overall spring constant, via which the seat platform is connected to the frame in a manner so as to be biased towards its folded position, thereby reducing an effort required by the user, who seats on the seat platform, for standing up therefrom, wherein the spring mechanism comprises a plurality of spring devices, each of which has an at least substantially constant spring characteristic which is at least substantially defined by a corresponding spring constant, and which are connected to each other in series, wherein the spring mechanism is provided such that, when the seat platform is at least substantially in its completely folded position, the variable overall spring constant is lower than in the case when the seat platform is at least substantially in its completely unfolded position, and wherein, when the seat platform is in its completely unfolded position, the overall spring constant is defined by the spring constants of only a fraction of the plurality of spring devices.

20 Claims, 6 Drawing Sheets

(58) Field of Classification Search
USPC ..... 297/6, 332; 135/67
See application file for complete search history.

(56) References Cited

U.S. PATENT DOCUMENTS

| | | | | |
|---|---|---|---|---|
| 6,371,142 | B1 | 4/2002 | Battiston | |
| 2012/0187733 | A1* | 7/2012 | Lin | A47C 4/04 297/332 |

FOREIGN PATENT DOCUMENTS

| | | | | |
|---|---|---|---|---|
| DE | 4110651 | A1 | 10/1992 | |
| DE | 19619074 | A1 | 11/1997 | |
| EP | 0719693 | A2 * | 7/1996 | A61G 5/08 |

* cited by examiner

SEAT DEVICE AND ASSISTIVE WALKER DEVICE COMPRISING THE SEAT DEVICE

CROSS-REFERENCE TO RELATED APPLICATION

The priority of Singapore Patent Application No. 10201502867Q filed Apr. 10, 2015 is hereby claimed under the provisions of 35 USC 119. The disclosure of Singapore Patent Application No. 10201502867Q is hereby incorporated herein by reference, in its entirety, for all purposes.

TECHNICAL FIELD

The present invention relates to a seat device and an assistive walker device comprising the seat device.

BACKGROUND

Seat devices and assistive walker devices are used for medical therapy of people, especially children, e.g. afflicted with conditions of weak limbs such as cerebral palsy, muscle hypotonia, and global development delay. Such a therapy relies on walking training for the user using an assistive walker device as a training device, which is quite tiring and requires frequent rest for the user. However, rest periods are disruptive for the training and require that the user leaves the walker to sit down elsewhere. In particular, the repeatedly transition from a sitting position after a rest period into a standing position to continue the training is exhausting for the user.

Furthermore, assistive walker devices are also used in geriatric applications as rollators for elderly people which have similar difficulties to get up from a sitting position.

A conventional assistive walker device is widely used in medical therapies and geriatric applications. However, when using the conventional walker, the user frequently has to leave the walker to sit down and rest since the conventional walker provides no seating accommodation, or in case of rollators, a seat may be integrated, but said seats are difficult to deploy and store. Furthermore, the user has to perform the transition from the sitting to the standing position by own effort or under assistance of a therapist/care giver. Hence, the transition from the sitting to the standing position is tiresome for the user, requires one-on-one assistance of the therapist, reduces productivity and training intensity, and/or convenience for the user. Consequently, getting up for the user is an obstacle to the next walking sequence and the therapy in general. To overcome said drawbacks of conventional assistive walker devices, the present invention provides a seat device which can be integrated in an assistive walker device and which furthermore supports the user during transition from the sitting to the standing position.

SUMMARY

The invention provides a seat device according to claim 1 and an assistive walker device according to claim 22. Further embodiments of the claimed devices are described in the dependent claims.

The seat device according to one embodiment of the present invention comprises a frame, a seat platform (e.g. a folding seat) which is hinged to the frame so as to be pivotable between a completely folded position (e.g. a stored position) and a completely unfolded position (e.g. a support position), in which a user is allowed to seat thereon, and a spring mechanism. There may be provided a single spring mechanism or there may be provided a plurality of spring mechanisms (e.g. two, three, four, five, or more) which may be arranged in parallel to each other. The (respective) spring mechanism has, e.g., a variable overall spring constant (i.e. different spring constants at different positions of the seat platform during folding/unfolding of the seat platform), via which the seat platform is connected to the frame in a manner so as to be biased towards its folded position, thereby reducing an effort required by the user, who seats on the seat platform, for standing up therefrom. The (respective) spring mechanism comprises a plurality of spring devices (e.g. two, three, four, five, or more), each of which has an at least substantially constant spring characteristic (e.g. a linear characteristic of spring force between an extended/non-extended position) which is at least substantially defined by a corresponding spring constant, and which are connected to each other in series. The spring devices may be implemented as a respective single spring device, such as a single spring, or may each be formed of a plurality of spring devices which are connected with each other in series and/or in parallel to form a respective spring device. The spring devices may be arranged in the series connection in an order with increasing/decreasing spring constants with respect to the adjacent spring, or may be arranged in an arbitrary order. The spring devices may each have the same spring constant. The (respective) spring mechanism is provided such that, when the seat platform is at least substantially in its completely folded position, the variable overall spring constant is lower than in the case when the seat platform is at least substantially in its completely unfolded position (i.e., a biasing force in the at least substantially completely folded position is lower than a biasing force in the at least substantially completely unfolded position), and wherein, when the seat platform is at least substantially in its completely unfolded position, the overall spring constant is defined by the spring constants of only a fraction (e.g. one, two, or three) of the plurality of spring devices (e.g. the fraction may include that/those of the plurality of spring device(s) that has/have the largest spring constant(s)).

The spring devices may comprise respectively different spring constants.

In the at least substantially completely folded position of the seat platform, the variable overall spring constant may be defined by at least that spring device which has the lowest spring constant.

In the at least substantially completely unfolded position of the seat platform, the variable overall spring constant may be exclusively (only) defined by that spring device which has the largest spring constant.

Each of the spring devices may be formed by an individual spring element or may be formed by a combination of a plurality of spring elements (e.g. connected in series and/or in parallel).

The individual spring element may be selected from a group comprising a linear coil spring, a torsion spring (e.g. a spiral spring), an air spring and a rubber spring element.

The spring devices may be selected from a group comprising pressure spring devices, tension spring devices and combinations thereof.

In the at least substantially completely unfolded position of the seat platform, the variable overall spring constant (of the respective spring mechanism) may be defined by only one of the plurality of spring devices. In the at least substantially completely unfolded position of the seat platform, the fraction of the plurality of spring devices, by which the overall spring constant is defined, may exclusively include those spring devices, which have the largest (individual) spring constant in comparison to the remaining spring devices of the plurality of spring devices.

In the at least substantially completely folded position of the seat platform, the variable overall spring constant may be defined by the spring constants of a majority or all of the plurality of spring devices (i.e., e.g., by the overall spring constant of the plurality of the series connection of spring devices).

The spring mechanism may be provided such that at any intermediate position between the completely folded and unfolded positions of the seat platform the variable overall spring constant is larger than in comparison to the case when the seat platform is at least substantially in its completely folded position and is lower in comparison to the case when the seat platform is at least substantially in its completely unfolded position.

The spring mechanism may be connected to the seat platform by means of a flexible cable, e.g. a belt, a band, a strap or by means of a pull rod. In addition, the seat platform may be attached directly onto the spring mechanism.

One or more of the plurality of spring devices (e.g. the spring device(s) having the lowest spring constant/lower spring constants of the plurality of spring devices) may include a spring loading travel blocking device for blocking spring travel of the corresponding spring device in a spring loading direction so as to limit the spring travel of the corresponding spring device in the spring loading direction to a predetermined spring loading travel limit (i.e. to limit the respective spring device to a predetermined maximum spring force). In case of compression springs, the spring loading travel blocking device may be an end stop, e.g. formed at a spring carrier connected with one end of the spring device and carrying the spring device, so that a spring carrier carrying the other end of the spring abuts against the end stop when the spring device is compressed, or may be achieved when the respective spring device is completely compressed and behaves then like a solid body (i.e. behaves at least substantially inelastic). In case of extension springs, the spring loading travel blocking device may be a stationary end stop (relative to the frame), against which the spring device or the spring carrier carrying the respective spring device abuts before the spring device is completely loaded, or may also be a flexible cable, e.g. in form of a belt, a strap, or may be a pull rod, connecting the two ends/spring carriers of the respective spring device with each other so as to limit further extension of the respective spring device. When the spring loading travel limit is reached, (a force is e.g. directly transferred to the respectively adjacent spring device and) the spring constant of that spring device, the spring loading travel of which is blocked, is then excluded from defining the variable overall spring constant (i.e. the blocked spring device is shunt out/excluded from the series connection of the plurality of spring devices and behaves, e.g., like an at least substantially inelastic body).

The spring loading travel blocking device may be adjustable, e.g. by an adjustment screw or a rack gear, so as to allow adjustment of the spring loading travel limit, e.g. in order to adjust the biasing force of the corresponding spring device and/or of the spring mechanism.

One or more of the plurality of spring devices (e.g. the spring device(s) having the largest spring constant/larger spring constants of the plurality of spring devices) may include a spring unloading travel blocking device for blocking spring travel of the corresponding spring device in a spring unloading direction so as to limit the spring travel of the corresponding spring device in the spring unloading direction to a predetermined spring unloading travel limit (i.e. to maintain a preloading force of the respective spring device at a predetermined level). In case of compression springs, the spring unloading travel blocking device may be a stationary end stop (relative to the frame), against which the spring device or the spring carrier carrying the respective spring device abuts before the spring device is completely unloaded, or may be a flexible cable as described for the spring loading travel blocking device. In case of extension springs, the spring unloading travel blocking device may be an element, e.g. an at least substantially non-elastic push rod (e.g. a rod capable of sustaining a compression force) connecting the two ends/spring carriers of the respective spring device with each other. When the spring unloading travel limit is reached, (a force is e.g. directly transferred to the respectively adjacent spring device and) the spring constant of that spring device, the spring loading travel of which is blocked, is then excluded from defining the variable overall spring constant.

The spring unloading travel blocking device may be adjustable, e.g. by an adjustment screw or a rack gear, so as to allow adjustment of the spring unloading travel limit, and thereby may serve to, e.g., preload the respective spring device in the spring unloading direction in order to adjust the (initial) biasing force of the corresponding spring device to, e.g., adjust the spring mechanism to different weights of different users.

At least one of the plurality of spring devices (e.g. the one spring device having the largest spring constant or, e.g., the two spring devices having the two largest spring constants) may include an adjustable spring preloading device for preloading the respective spring device in the spring unloading direction with a predetermined force so as to adjust the spring mechanism to different weights of different users, i.e., to adjust the biasing force of the corresponding spring device towards the completely folded position. The adjustable preloading device may be configured such that it shortens or lengthens an initial length (e.g. in the completely folded position) of the spring device via adjustment of the length of the adjustable spring preloading device, e.g., by an adjustment screw or a rack gear, without influencing a/the spring travel limit in a loading and/or unloading direction.

An indicator may be provided for the spring mechanism in order to visualize the spring force(s), e.g. for the user or a therapist/care giver, which are currently adjusted/set (e.g. an indicator showing a weight of the user which can be optimally supported by the spring mechanism using the current spring setting).

The frame may comprise a back rest.

The seat platform may be provided to abut against, e.g., the back rest in the completely folded position.

The frame may comprise lateral frame portions which are arranged in a lateral distance from each other so as to leave an intermediate space therebetween, in which a user can stay, wherein the seat platform may be arranged such as to extend at least substantially horizontally into the intermediate space, when being in its completely unfolded position, so as to allow the user to seat thereon, and to be folded out of the intermediate space, when being in its completely folded position, so as to allow the user to stand/walk in the intermediate space at least without substantial interference with the seat platform. Each of the lateral frame portions may be provided with an upper rest portion (e.g. an arm rest portion), which can be gripped by the user standing (or, e.g., sitting on the seat platform) in the intermediate space to thereby allow the user to support himself thereon with his/her arms during standing (and/or, walking and/or standing up).

The frame may comprise a rear frame portion, to which the seat platform is hinged to.

The seat device may comprise one or two (or more) spring mechanisms of the type as described in this application, which is/are arranged at (e.g. one of) opposite lateral sides of the intermediate space, e.g. at a back side of the frame.

The frame may be provided with wheels (e.g. two fixed direction wheels and two steerable wheels) allowing the seat device to be moved in a rolling manner.

The assistive walker device according to the present invention comprises the seat device as described in this application.

The assistive walker device of the present invention allows a person undergoing a walking therapy or using the assistive walker device in an geriatric application as a rollator to frequently rest on the seat device without leaving the assistive walker device, whereby efficiency of the therapy is increased and/or time required for the therapy is reduced, and whereby the person is supported during transition from the seating position to the standing position by a spring force which is stronger in the seating position and reduced in the standing position, which makes the therapy less tiresome for the person/patient and allows for a more intense therapy.

It is to be noted that all spring devices of a respective spring mechanism may be provided with a spring loading travel blocking device and/or a spring unloading travel blocking device, whereby a corresponding maximum travel of the seat platform may be defined (e.g. limited) by maximum unloading and/or loading travel of the spring mechanism. In this case, the completely folded and/or unfolded positions are correspondingly defined by the maximum loading/unloading travel of the spring mechanism and, hence, in the completely folded and/or unfolded positions there would be then no more spring effect anymore. The previous and succeeding formulations "at least substantially in the folded/unfolded position" take account of this technical possibility in that the correspondingly described overall spring constant is (at least) present when the seat platform approaches its folded/unfolded position and is then close to or at least substantially in its folded/unfolded position.

DETAILED DESCRIPTION OF EMBODIMENTS OF THE DESCRIPTION

Various features in various embodiments may be combined to form further embodiments.

Figure 1:
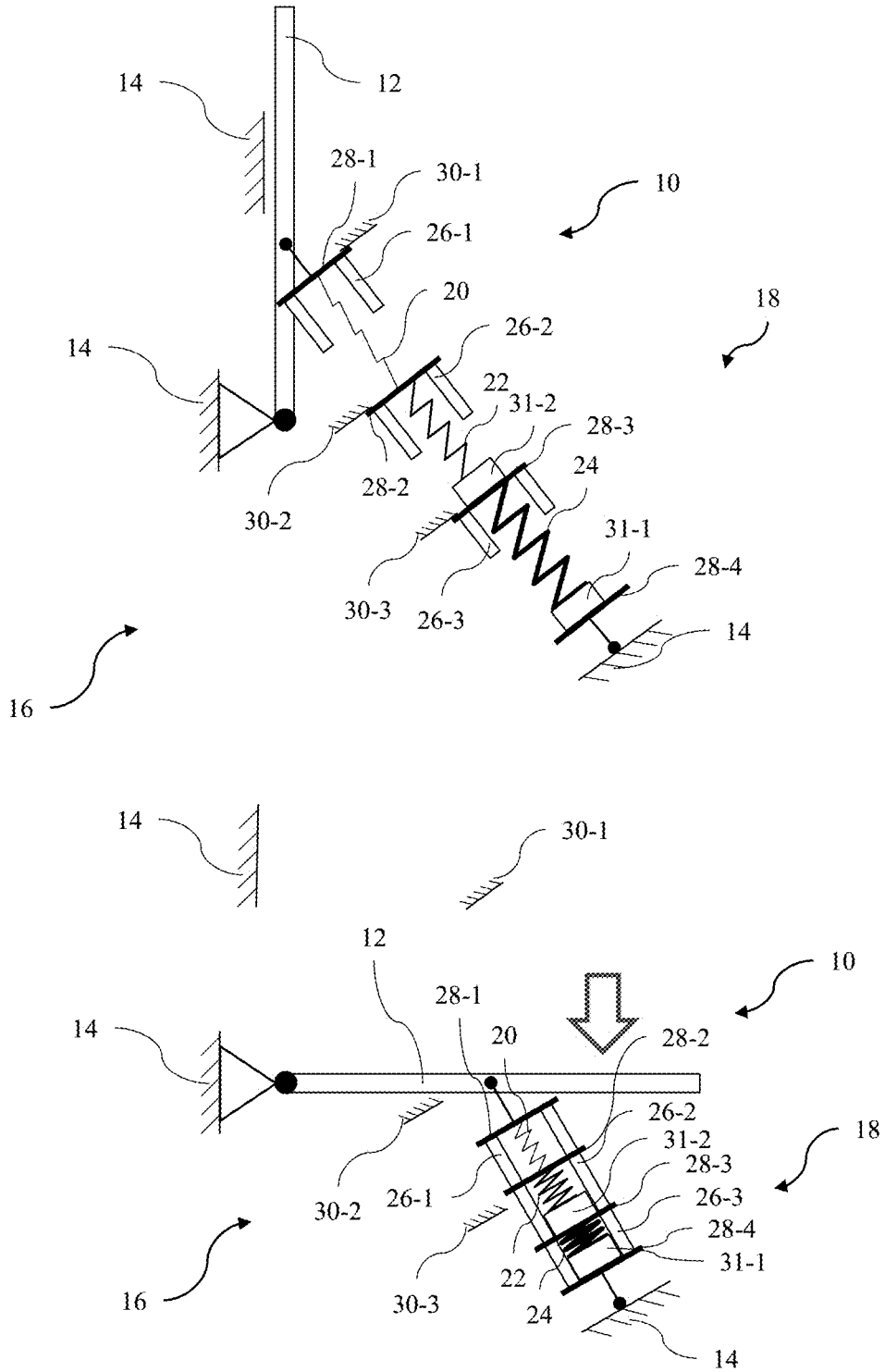
FIG. 1 is a schematical view of an exemplary seat device in a completely folded position (upper half of FIG. 1) and a completely unfolded position (lower half of FIG. 1) using a spring mechanism with three compression springs, three spring loading travel blocking devices and three spring unloading travel blocking devices.

FIG. 1 is a schematical view of a seat device 10. The seat device 10 comprises a foldable seat platform 12 which is hinged to a frame 14, e.g. of an assistive walker device 16 (which is described in more detail further below), and two spring mechanisms 18 (only one spring mechanism is shown and described since in this embodiment the other spring mechanism is identical) each provided at a lateral side of the seat platform 12 and connecting the frame 14 with the seat platform 12, wherein the seat platform 12 is pivotable with respect to the frame 14 between an at least substantially vertical position (completely folded position) and an at least substantially horizontal position (completely unfolded position). In the completely folded position, the seat platform 12 is biased by the spring mechanisms 18 towards the frame 14 so as to store the seat platform 12 in a space saving manner (e.g. at least substantially folded against the frame 14), and in the (completely) unfolded position a person (not shown), e.g. a child, can sit on the seat platform 12 which supports the weight of the person sitting on the seat platform 12 and supports (pushes) the person during transition from a seating position to a standing position by the force exerted by the spring mechanisms 18.

In this embodiment, the respective spring mechanism 18 is provided as a compression type mechanism with three compression springs 20, 22, and 24 (e.g. helical springs), which are connected in series between the frame 14 and the seat platform 12. At their ends, the springs 20, 22, and 24 are coupled with respective spring carriers 28, i.e. starting from the frame 14, a first spring carrier 28-1 is hinged thereto and coupled with an end of the spring 20, a second spring carrier 28-2 is coupled with the other end of spring 20 and coupled with an end of spring 22, a third spring carrier 28-3 is coupled with the other end of spring 22 and coupled with an end of spring 24, and a fourth spring carrier 28-4 is coupled with the other end of spring 24 and hinged to the seat platform 12, whereby the series connection of the springs 20, 22, and 24 in the spring mechanism 18 is achieved. The three springs 20, 22, and 24 have different spring constants from each other, wherein, e.g., the spring 20 has the lowest spring constant, the spring 24 has the highest spring constant, and the spring 22 has an intermediate spring constant between those of springs 20 and 24. The spring constants allow for an at least substantially linear gradient of force between a minimum extension length (i.e. a minimum length of the springs at the completely unfolded position of the seat platform 12) and a maximum extension length (i.e. a maximum length of the springs at the completely folded position of the seat platform 12) of the springs 20, 22, and 24. Furthermore, the spring mechanism 18 of this embodiment includes three spring loading travel blocking devices 26-1, 26-2, and 26-3 which are provided to limit the minimum extension length of the respective spring in a loading direction of the spring mechanism 18. For this reason, the three spring loading travel blocking devices 26-1, 26-2, and 26-3 are respectively formed at the first spring carrier 28-1, the second spring carrier 28-2, and the third spring carrier 28-3 and are formed as an end stop protruding in an axial direction of the springs, e.g. in form of a push rod, and defining a predetermined distance between the spring carriers 28-1, 28-2, 28-3, and 28-4 of the springs 20, 22, and 24 when contacting the corresponding spring carrier, e.g. in the completely unfolded position of the seat platform 12. In addition, the spring mechanism 18 of this embodiment includes three spring unloading travel blocking devices 30-1, 30-2, and 30-3. The spring unloading travel blocking devices are provided to limit the maximum extension length of the respective spring in an unloading direction of the spring mechanism 18. For this reason, the three spring unloading travel blocking devices 30-1, 30-2 and 30-3 are provided as a stationary end stop for the respective spring carriers 28-1, 28-2 and 28-3 defining a predetermined distance between the spring carriers 28-1, 28-2, 28-3, and 28-4 of the springs 20, 22, and 24 in the completely folded position of the seat platform 12 when the spring carriers of the corresponding springs abut against the corresponding spring unloading travel blocking devices 30-1, 30-2, and 30-3.

Furthermore, the spring mechanism 18 of this embodiment is provided with two adjustable spring preloading devices 31-1 and 31-2 for springs 24 and 22, respectively, wherein the adjustable spring preloading device 31-1 connects with one end to the end of spring 24 which is in proximity to spring carrier 28-4 and connects with the other end to the spring carrier 28-4 itself, and the adjustable spring preloading device 31-2 connects with one end to the end of spring 22 which is in proximity to spring carrier 28-4 and connects with the other end to the spring carrier 28-3 itself. The adjustable spring preloading devices 31-1 and 31-2 are at least substantially inelastic and adjustable in length in the spring loading/unloading direction, e.g. by an adjustment screw, so as to lengthen/shorten the respective spring between its corresponding spring carriers. By doing so, the respective spring is preloaded with a predetermined force in the spring unloading direction so as to adjust the spring mechanism 18 to different weights of different users, e.g. in case of a heavy user the length of spring 24 is shortened to increase the biasing force of spring 24 towards the completely folded position. Hence, the biasing force of the respective spring is adjustable without effect on the travel length of the spring in the unloading direction since the travel length of the spring is limited by the corresponding spring unloading travel blocking device.

Figure 2:
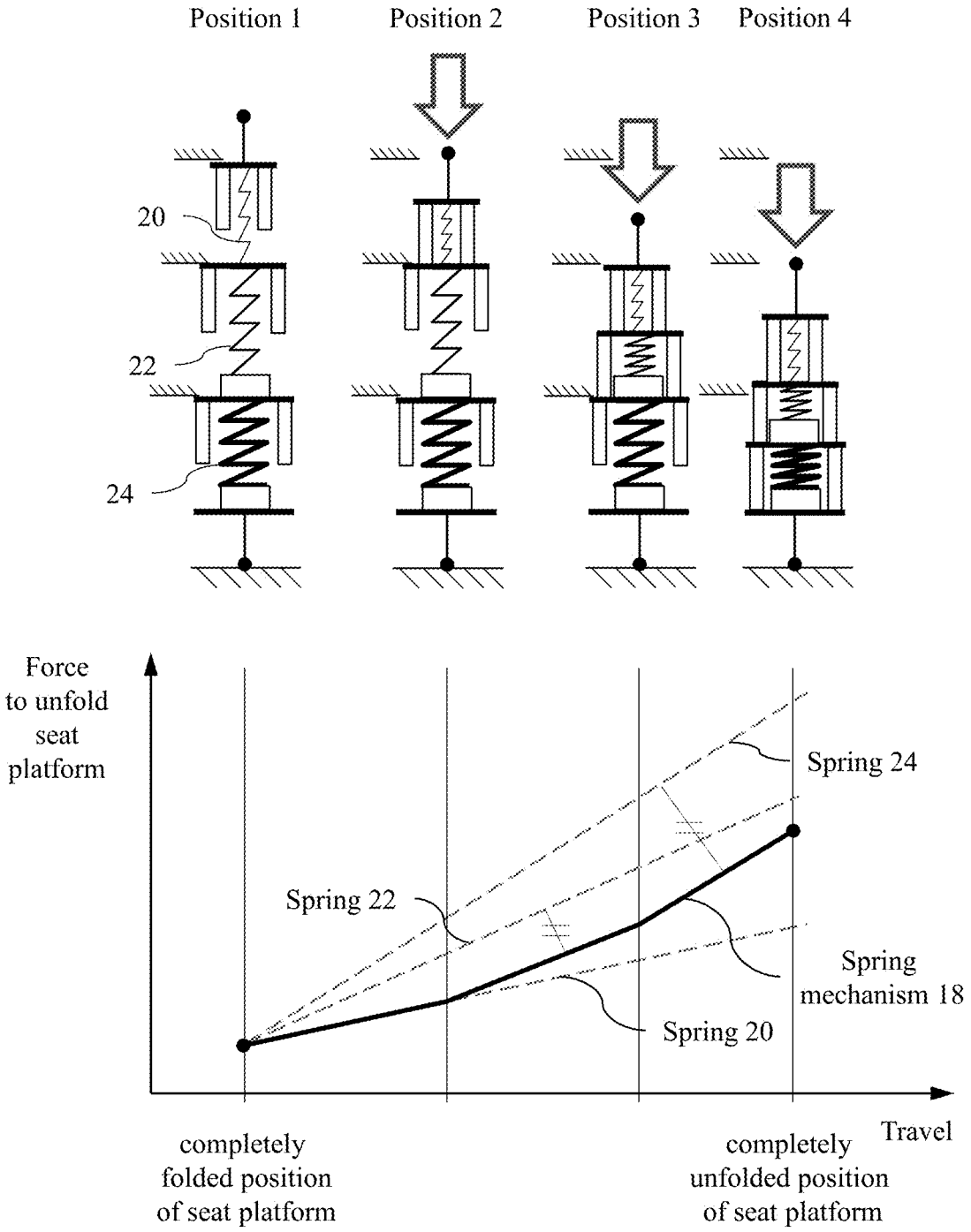
FIG. 2 is a graph showing the spring characteristic and the change of the spring characteristic at discrete positions of the spring mechanism of FIG. 1 during unfolding when loaded by a force to unfold the seat platform.

With regard to FIG. 2, which is a graph showing the spring characteristics of the spring mechanism of FIG. 1 when loaded by a force to unfold the seat platform 12, the operation of the respective spring mechanism 18 is described. In FIG. 2 the x-axis of the graph designates the travel distance of the seat platform 12 (and, hence the compression of the spring mechanism 18), and the y-axis designates the force necessary to unfold the seat platform 12.

Starting from the completely folded position (position 1) in FIG. 2, springs 20, 22 and 24 abut against their respective spring unloading travel blocking devices 30-1, 30-2, and 30-3 in unloading direction, i.e. folding direction, and, hence, do not contribute to the overall spring constant of the spring mechanism 18. At position 1 the seat platform 12 is preloaded (biased) by the spring force of spring 20 to remain in the completely folded position, and the spring loading travel blocking devices 26-1, 26-2, and 26-3 of springs 20, 22, and 24 are not in engagement with their corresponding spring carriers 28-2, 28-3, and 28-4. To overcome the preloading force of spring 20 during unfolding the seat platform 12, e.g. if a child grabs the seat platform 12 to unfold it to sit down thereon, only the force associated with spring 20 has to be overcome since the spring force of spring 20 is lower than the preloading force of springs 22 and 24 so that springs 22 and 24 stay abutted against their respective spring unloading travel blocking devices 30-2 and 30-3 when the spring 20 is separated from its spring unloading travel blocking device 30-1 by the unfolding force. In consequence, the spring constant of spring 20 is then the effective spring constant of the spring mechanism 18 during unfolding of the seat platform from position 1 to position 2.

At position 2 of FIG. 2, the spring loading travel blocking device 26-1 contacts the corresponding spring carrier 28-2 so that spring 20 is shunt out/bypassed, i.e. does not define the current spring constant of the spring mechanism 18 anymore. If additional unfolding force is applied, the abutment force (preloading) of spring 22 is overcome and spring 22 is pushed and compressed by the spring loading travel blocking device 26-1 and is separated from the corresponding spring unloading travel blocking device 30-2. The unfolding force applied in this state is higher than the maximum spring force of spring 20, but is less than the abutment force of spring 24 which still abuts against the spring unloading travel blocking device 30-3. Hence, only the spring constant of spring 22 is then effective during unfolding of the seat platform 12 between positions 2 and 3, e.g. when the child further pushes down the seat platform 12. In consequence, the spring constant of spring 22 then defines the overall spring constant of the spring mechanism 18 during unfolding of the seat platform from position 2 to position 3.

At position 3 of FIG. 2, the spring loading travel blocking device 26-2 contacts the corresponding spring carrier 28-3 so that spring 22 is also shunt out, i.e. does not define the current spring constant of the spring mechanism 18 anymore. If additional unfolding force is applied, the abutment force of spring 24 is overcome and spring 24 is pushed and compressed by the spring loading travel blocking device 26-2 and is separated from the corresponding spring unloading travel blocking device 30-3. The unfolding force applied in this state is higher than the spring force of spring 22. Hence, since both springs 20 and 22 are shunt out, only the spring constant of spring 24 is then effective between positions 3 and 4 and defines the overall spring constant of the spring mechanism 18, e.g. when the child starts to sit on the yet not completely unfolded seat platform 12 and pushes the seat platform 12 further down by his/her weight.

At position 4 of FIG. 2 the seat platform 12 is in its completely unfolded position. In this state the spring loading travel blocking device 26-3 contacts the spring carrier 28-4 of spring 24, so that also spring 24 is shunt out/bypassed and does not define the overall spring constant of the mechanism anymore; i.e., since all springs 20, 22, and 24 are shunt out at position 4, the spring mechanism 18 is maximally compressed and no more spring constant is effective. In this state, the spring mechanism 18 exerts a biasing force on the seat platform 12 towards its folded position which corresponds to the strongest spring, which is in this case spring 24. If at position 4 additional force in the unfolding direction is applied in excess of the biasing force of the spring mechanism 18, e.g. by a child fully sitting on the seat platform 12, the additionally exerted force is then (additionally) supported via the in this state (at least substantially) rigid spring mechanism 18, i.e. without further spring force effect. Hence, a load force fraction in excess of the biasing force of the strongest spring 24 is supported by the spring mechanism 18 in an inelastic manner. If the child wants to stand up again after a rest period, e.g. sitting on the seat platform 12, the force by which the seat platform 12 is biased towards the frame 14 is exclusively defined by the (initial) force of spring 24, so that the transition of the child from the seating position to the standing position is supported by the force of spring 24, i.e. the child does not have to lift his/her complete weight when standing up since she/he is pushed by spring force. The folding operation of the seat platform is performed in reversed order.

In this embodiment, the spring unloading travel blocking devices 30-1, 30-2, and 30-3 may be adjustable in their positions along the loading/unloading direction of the spring mechanism 18 to change the preloading of the corresponding spring, e.g. to adjust the characteristics of the spring mechanism 18 to different weights of different children. The adjustment of the spring unloading travel blocking devices 30-1, 30-2, and 30-3 may be achieved by, e.g., an adjustment screw. Furthermore, e.g., if no preloading or merely preloading of a fraction of the plurality of springs of the spring mechanism 18 is required, one, two, or all spring unloading travel blocking devices 30-1, 30-2, and 30-3 may be omitted. The same applies for the adjustable spring preloading devices 31-1 and 31-2 in the case that no preloading or merely preloading of a fraction of the plurality of springs of the spring mechanism 18 is required. E.g., if the spring unloading travel blocking device 30-1 of spring 20 is omitted, the seat platform 12 may be in a free floating state in the completely folded position, i.e. it is (dynamically) held in place by the force of spring 20, or may e.g. abut against the frame 14.

In this embodiment also the spring loading travel blocking devices 26-1, 26-2, and 26-3 may be adjustable in their length to thereby change the force required to shunt out the corresponding spring. E.g., it may be possible to adjust the spring loading travel blocking device 26-1 in its length (e.g. shorten) so that the force required to shunt out spring 20 is higher than the abutment force of spring 22. In this case, when the abutment force of spring 22 is reached, but the force required to shunt out spring 20 is not yet reached, springs 20 and 22 function in a series connection so that the overall spring constant of these two springs is lower than that of the spring 20, which has the lowest spring constant in the spring mechanism 18. The adjustment of the spring loading travel blocking devices 26-1, 26-2, and 26-3 may be achieved by, e.g., an adjustment screw. Additionally, if no spring loading travel limit or merely of a fraction of the plurality of springs of the spring mechanism 18 is required, one, two, or all spring loading travel blocking devices may be omitted. E.g., if the spring loading travel blocking device 26-3 of spring 24 is omitted, the seat platform 12 is free floating in the completely unfolded position, i.e. it is (dynamically) held in place by the force of spring 24 when the child is seated on the seat platform 12.

In other words, by adjusting and/or omitting the spring loading travel blocking devices 26-1, 26-2, and 26-3 and/or the spring unloading travel blocking devices 30-1, 30-2, and 30-3 it may even be possible to use all springs of the spring mechanism 18 in a series connection (in terms of effective spring constants) during predetermined intervals of the unfolding operation of the seat platform 12.

Furthermore, in this embodiment, an additional damping element, e.g. a speed control damper, may be mounted between the seat platform 12 and the frame 14 to slow down the speed of the seat platform folding operation to a desired level so that the child standing up is not surprised and/or injured by the seat platform 12 snapping back towards the frame 14.

Figure 3:
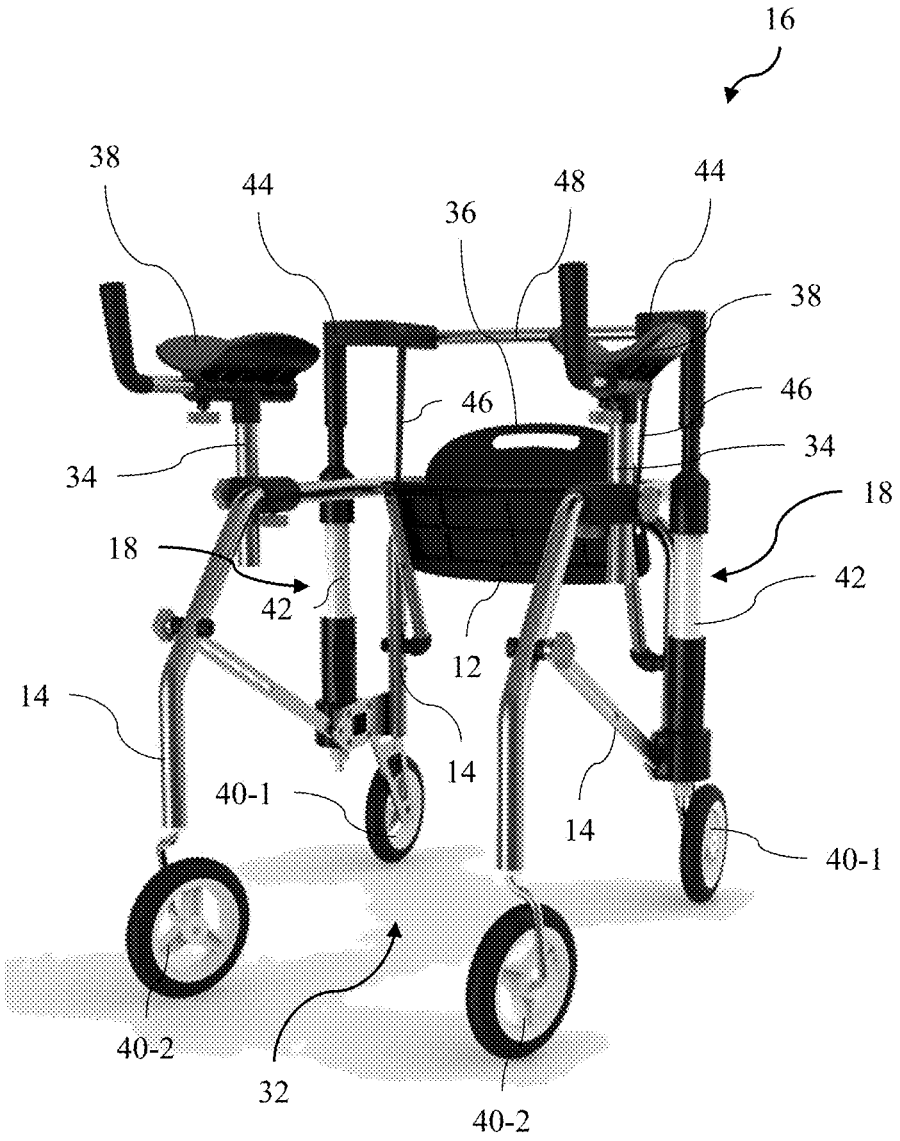
FIG. 3 shows an isometric view of an exemplary assistive walker device comprising the seat device of FIG. 1.

With regard to FIG. 3, an embodiment of the exemplary assistive walker device 16 provided with the above seat device 10 is described. The assistive walker device 16 is formed by the frame 14 which leaves an intermediate space 32 in the assistive walker device 16 for the person to stay in. The intermediate space 32 is open to the top, the bottom and the front so that the person can enter/leave the assistive walker device 16 via the front side, and the intermediate space 32 is limited by the frame 14 at the lateral sides and the back side. The frame 14 further comprises lateral frame portions 34 which are arranged in a lateral distance from each other so as to leave the intermediate space 32 therebetween and a back rest 36 disposed at the back side of the intermediate space 32 at the frame 14 and facing the intermediate space 32. The lateral frame portions 34 are each provided with an upper rest portion 38 (e.g. an arm rest) in a manner so that the user in the intermediate space 32 can support his/her forearms thereon and/or grip the upper rest portion 38 to thereby allow the user to support himself/herself thereon with his/her arms during standing, walking and/or standing up. The lateral frame portions 34 and/or the upper rest portions 38 may be adjustable in terms of position and layout, e.g. by sliding mechanisms, to be adaptable with regard to different anatomies of the users. As described above, the seat platform 12 is hinged to the frame 14 and is provided at the back side of the intermediate space 32 to allow the user to sit on when the seat platform 12 is in the (completely) unfolded position. Therefore, the seat platform 12 is arranged so as to extend at least substantially horizontally into the intermediate space 32 when in the completely unfolded position and to be at least substantially folded out of the intermediate space 32 when being in its completely folded position. In its completely folded position, the seat platform 12 may abut against the back rest 36 or the frame 14. Furthermore, the frame 14 of the assistive walker device 16 is provided with wheels 40 which are coupled to the frame 14 at lower portions thereof. Here, e.g., a non-steerable wheel 40-1 is provided at a respective lower, lateral back side portion of the frame 14, and a steerable wheel 40-2 is provided at a respective lower, lateral front side portion of the frame 14 to allow the user to move and to steer the assistive walker device 16 in a rolling manner. At least one of the wheels 40 may be temporarily blocked/clamped by a braking mechanism to selectively render the assistive walker device 16 immobile during transition from/into the seating position.

In this embodiment, the spring force for the seat platform 12 of the seat device 10, in order to bias the seat platform 12 towards the back rest 36, is provided by spring mechanisms 18 (e.g. two spring mechanisms) of the compression spring type (as described with regard to FIG. 1), which are coupled to the lateral sides of the frame 14. Each spring mechanism 18 is provided in a housing 42 due to aesthetic and/or safety reasons and fixed to the lateral side of the frame 14 so as to exert its spring force in an at least substantially vertical manner. Moveable top portions 44 of the housings 42 of the spring mechanisms 18 are connected with one another by a transverse bar 46 (e.g. also used as a push bar for the therapist/care giver to move the assistive walker device 16 around), which is located at the upper back side of the frame 14 and above the back rest 36. Connected between the moveable top portions 44 and the seat platform 12 are respective flexible cables, e.g. belts 48, (e.g. one connected with each top portion 44) which serve to transmit the spring force of the two spring mechanisms 18 to the seat platform 12. The belts 48 may be at least substantially non-elastic.

With regard to further preferred embodiments of the seat device 10 provided in the assistive walker device 16, one single spring mechanism 18 or a plurality of spring mechanisms, e.g. two, three, four, five or more, may be used in the seat device 10. The spring mechanism(s) may be also directly, i.e. without a belt 48, connected to the seat platform 12 and the frame 14, e.g. via torsion springs of which one end may be connected to a hinge axis fixed to the frame 14, and the other end may be connected to the seat platform 12 pivotable around the fixed hinge axis. In the case of torsion springs, the spring loading/unloading travel blocking devices, if implemented, may be stationary rotational end stops at discrete angels of rotation of the seat platform 12. Furthermore, if a compression type spring mechanism is used, one end, e.g. the moveable top portion 44 of the housing 42, may be directly hinged to the seat platform 12, whereas the other end of the housing 42 may be hinged to the frame 14.

Figure 4:
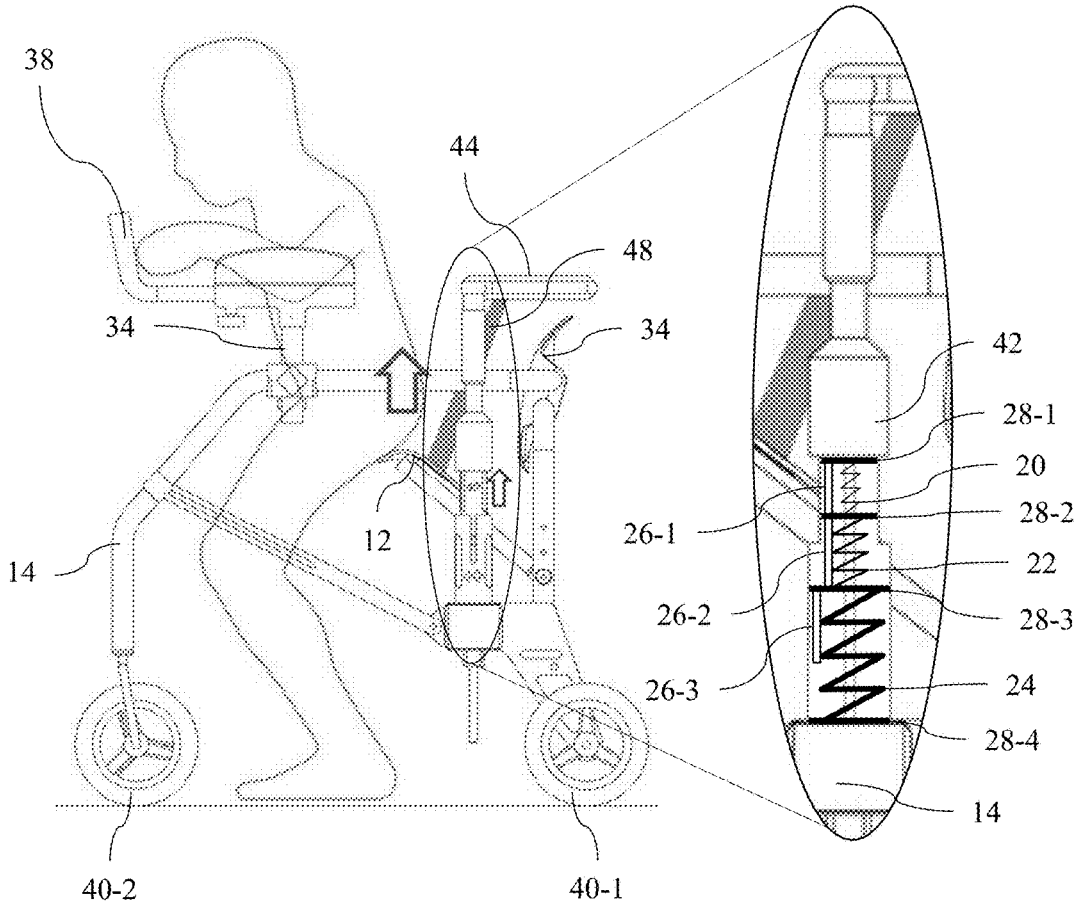
FIG. 4 shows a schematical side view of the assistive walker device of FIG. 3 comprising the seat device of FIG. 1, wherein the seat device is in transition from the unfolded to the folded position helping a person to stand up.

With regard to FIG. 4, a scheme of folding the seat platform 12 and supporting the user during transition from the sitting position to the standing position is described. Therefore, FIG. 4 shows a schematic side view of the assistive walker device 16 with a user in transition from the seating position to the standing position, wherein one spring mechanism 18 (of two) is exemplarily shown in an enlarged section view of FIG. 4 and described. Here, the assistive walker device 16 comprises the seat device 10 which includes the spring mechanism 18. In this embodiment, the exemplary spring mechanism 18 exerts an upward directed pushing force and comprises the three compression type springs 20, 22, and 24 provided in the housing 42 and connected in series, the spring carriers 28-1, 28-2, 28-3, and 28-4 connecting the springs 20, 22 and 24 with one another, and the spring loading travel blocking devices 26-1, 26-2, and 26-3 limiting the loading travel distance of the spring mechanism 18. For the sake of simplicity, the spring unloading travel blocking devices 30-1, 30-2 and 30-3 and the adjustable spring preloading devices 31-1 and 31-2 are not shown in FIG. 4.

With regard to the folding scheme of the seat platform 12, at an initial point of the folding of the seat platform 12, while the user is seated on the completely unfolded seat platform 12, the seat platform 12 supports the user's weight so that the user's weight force is equaled by the spring force exerted by the spring 24 of the spring mechanism 18 and the (at least substantially) inelastic spring mechanism 18 (which is achieved by the spring loading travel blocking devices 26-1, 26-2, and 26-3 which abut against the respective spring carriers 28-1, 28-2, 28-3, and 28-4, as shown at position 4 of FIG. 2) itself. During transition of the user, as it is shown in FIG. 4, the spring force exerted by spring 24 of the spring mechanism 18 pushes the seat platform 12 towards the back rest 36 and helps the user to stand up by pushing the user in a generally upward direction. To this end, the relatively strong spring 24 is effective and spring 24 extends so that the moveable top 44 of the housing 42 pulls the seat platform 12 upwards via the belt 48. As the weight of the user is more and more supported by his/her own legs and as the seat platform 12 is more and more folded towards the completely folded position, the spring force exerted by the spring mechanism 18 becomes lesser and lesser, so that at a predetermined unloading threshold force, e.g. defined by the position of the spring unloading travel blocking device 30-3, the spring 24 is shunt out by the spring unloading travel blocking device 30-3 and simultaneously the spring 22 is released. As even less spring force is required, e.g. to further fold up the seat platform 12 when the user does not contact the seat platform 12 anymore, the spring 22 is shunt out at a predetermined unloading threshold force by the spring unloading travel blocking device 30-2 and simultaneously the spring 20 is released. This results in an overall smooth folding operation of the seat platform 12 until spring 20 abuts against the spring unloading travel blocking device 30-1 so that the completely folded position of the seat platform 12 is reached. At least in this state the user stands without support of the seat platform 12 in the intermediate space 32 of the assistive walker device 16. Unfolding of the seat platform 12 from the completely folded position to the completely unfolded position is performed in reverse order.

Figure 5:
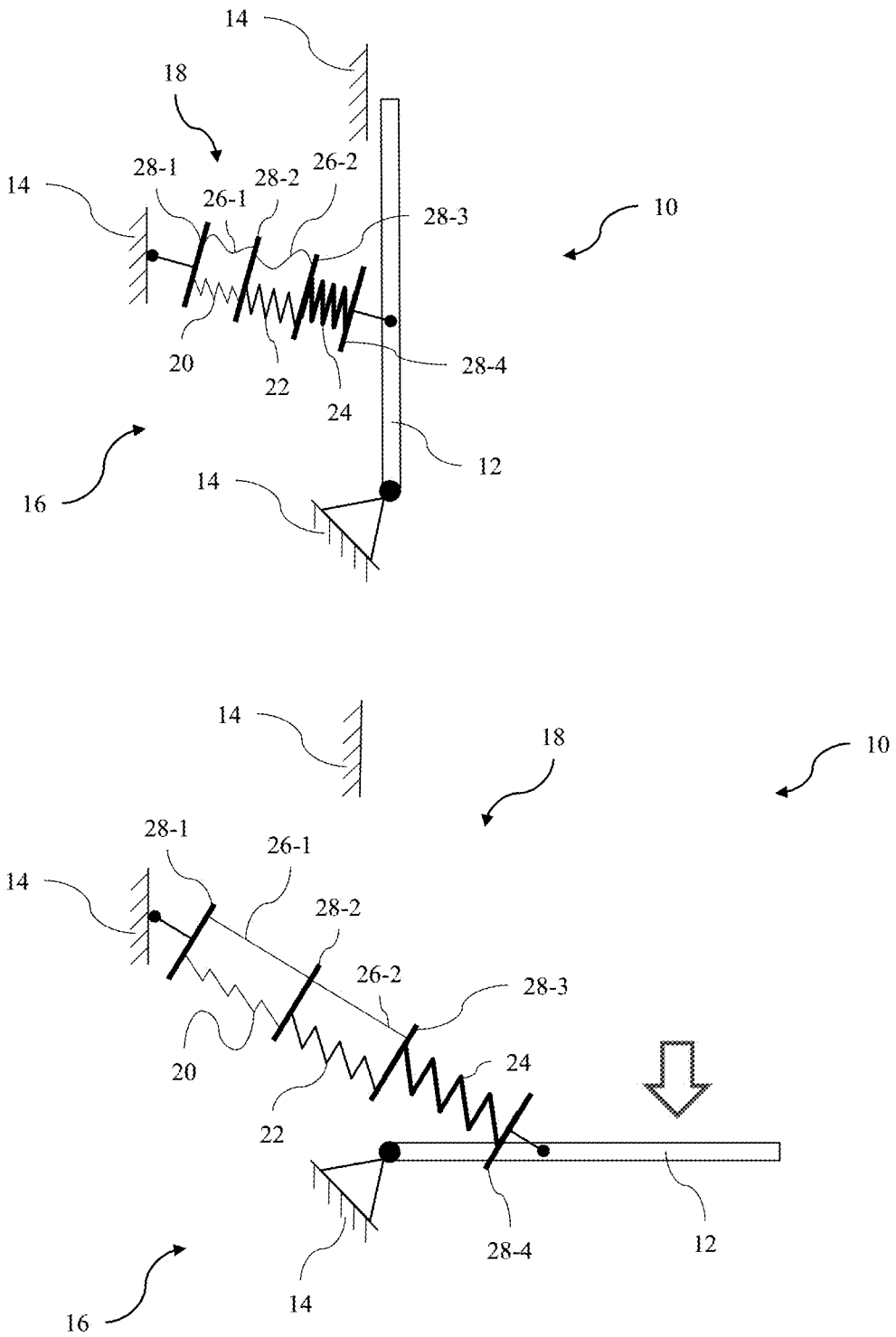
FIG. 5 is a schematical view of another exemplary seat device in a completely folded position (upper half of FIG. 1) and a completely unfolded position (lower half of FIG. 1) using a spring mechanism with three tension springs and two spring loading travel blocking devices.

With regard to FIG. 5, a schematical seat device 10 according to another exemplary embodiment of the present invention is shown. Except for the spring mechanisms 18, which are of an extension spring type, the seat device 10 remains the same as described above.

In this embodiment, the respective spring mechanism 18 is provided with three extension springs 20, 22, and 24 (e.g. coil springs), which are connected in series between the frame 14 and the seat platform 12. At their ends, the springs 20, 22, and 24 are coupled with a respective spring carrier 28, i.e. starting from the frame 14, a first spring carrier 28-1 is hinged thereto and coupled with an end of the spring 20, a second spring carrier 28-2 is coupled with the other end of spring 20 and coupled with an end of spring 22, a third spring carrier 28-3 is coupled with the other end of spring 22 and coupled with an end of spring 24, and a fourth spring carrier 28-4 is coupled with the other end of spring 24 and hinged to the seat platform 12, whereby the series connection of the springs 20, 22, and 24 in the respective spring mechanism 18 is achieved. The three springs 20, 22, and 24 have different spring constants from each other, wherein, e.g., the spring 20 has the lowest spring constant, the spring 24 has the highest spring constant, and the spring 22 has an intermediate spring constant between those of the springs 20 and 24. The spring constants allow for an at least substantially linear gradient of force between a minimum extension length (completely folded position of the seat platform 12) and a maximum extension length (completely unfolded position of the seat platform 12) of the springs 20, 22, and 24. Furthermore, the spring mechanism 18 includes two spring loading travel blocking devices 26-1 and 26-2 which are provided to limit the maximum extension length of the respective spring in a loading direction of the spring mechanism 18. For this reason, the two spring loading travel blocking devices 26-1 and 26-2 are mounted between the first spring carrier 28-1 and second spring carrier 28-2 and the second spring carrier 28-2 and the third spring carrier 28-3, respectively, and are formed as belts (e.g. also as pull rods and the like) defining predetermined distances between the spring carriers 28-1, 28-2 and 28-3 of the springs 20 and 22 during predetermined intervals of the unfolding of the seat platform 12. The spring loading travel blocking devices 26-1 and 26-2 may also be implemented as stationary end stops for the respective spring carriers so as to limit the maximum extension length of the corresponding springs. In the completely folded position of the seat platform 12, the spring loading travel blocking devices 26-1 and 26-2 do not limit the springs 20 and 22. In this exemplary embodiment, no spring unloading travel blocking devices and no adjustable spring preloading devices are provided; however, with regard to the above-teaching, the person of skill in the art may provide these if required. Furthermore, if required, a spring loading travel blocking device 26-3 may be used to limit the spring loading travel of spring 24 and, hence, limiting the overall loading travel distance of the spring mechanism 18.

Figure 6:
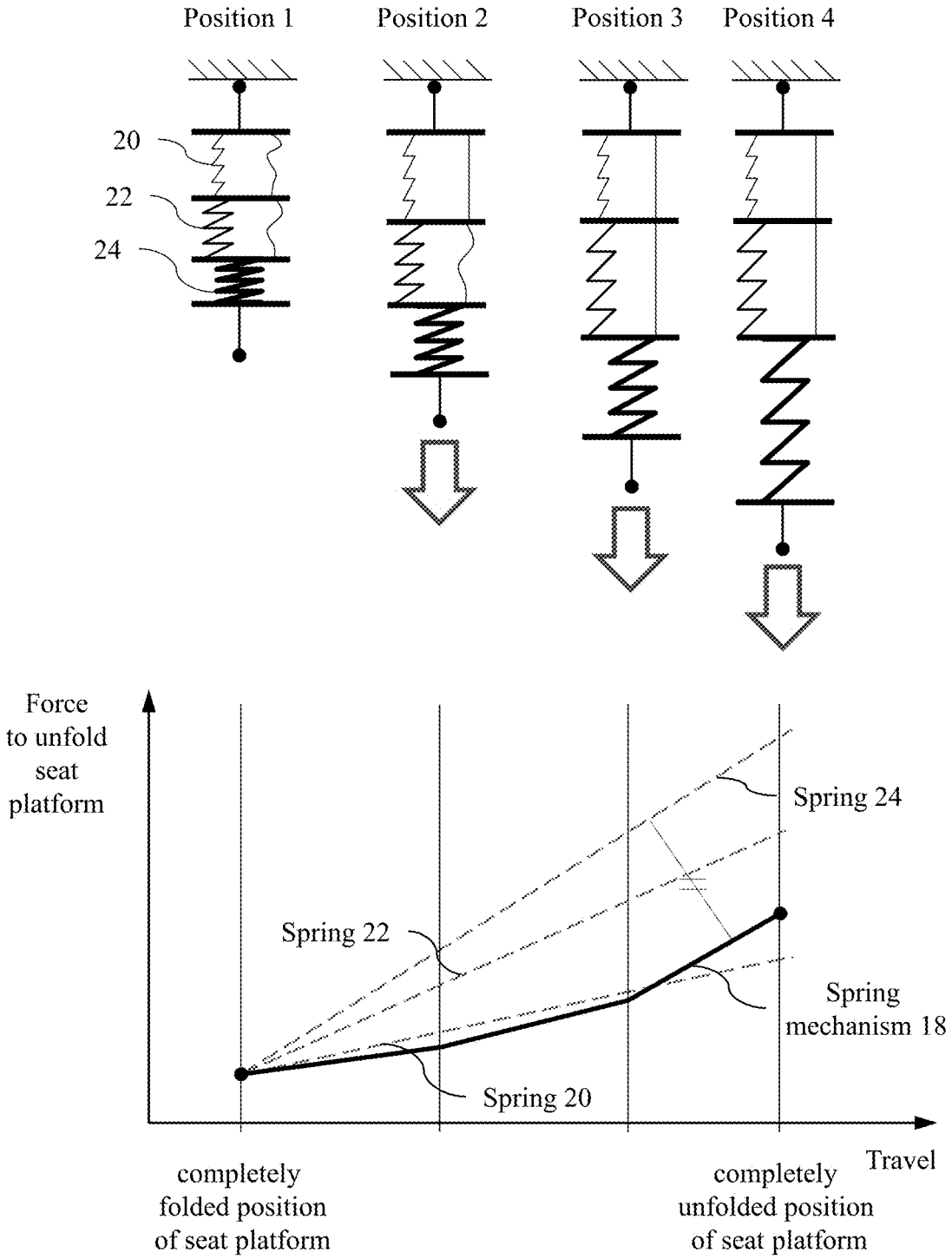
FIG. 6 is a graph showing the spring characteristics and the change of the spring characteristic at discrete positions of the spring mechanism of FIG. 5 during unfolding when loaded by a force to unfold the seat platform.

With regard to FIG. 6, which is a graph showing the spring characteristics of the spring mechanism of FIG. 5 when loaded by a force to unfold the seat platform 12, the operation of the respective spring mechanism 18 is described. In FIG. 6 the x-axis of the graph designates the travel distance of the seat platform 12 (and, hence, the extension of the spring mechanism 18), and the y-axis designates the force necessary to unfold the seat platform 12.

Starting from the completely folded position (position 1) in FIG. 6, in which the seat platform 12 is folded close to the frame 14 or the back rest 36 (i.e., the seat platform 12 is in a floating condition with regard to the frame 14 or the back rest 36, e.g. held in place by (dynamic) spring force of the spring mechanism 18), the spring force associated with the series connection of the springs 20, 22, and 24 has to be overcome to unfold the seat platform 12 since the springs 20, 22, and 24 are connected in series. In consequence, at position 1, the overall spring constant of the spring mechanism 18 is lower than that of the spring with the lowest spring constant (spring 20).

At position 2 of FIG. 6, the spring 20 reaches its maximum extension length limited by the spring loading travel blocking device 26-1, which is pulled tight so that the spring 20 is shunt out of the series connection of the springs 20, 22, and 24. The overall spring constant of the spring mechanism 18 is then defined by the spring constants of springs 22 and 24, i.e., the overall spring constant is lower than that of spring 22, but higher than between positions 1 and 2. In consequence, additional unfolding force applied at position 2 is higher and increases at a higher rate than between positions 1 and 2.

At position 3 of FIG. 6, the spring 22 also reaches its maximum extension length limited by the spring loading travel blocking device 26-2, which is also shunt out of the series connection of the springs 20, 22, and 24. The overall spring constant of the spring mechanism 18 is then defined by the spring constant of spring 24, i.e., the overall spring constant is that of spring 24. In consequence, additional unfolding force applied at position 3 is higher and increases at a higher rate than between positions 2 and 3, e.g., when the child starts to sit down on the yet not completely unfolded seat platform 12 and pushes the seat platform 12 further down by his/her weight.

At position 4 of FIG. 6, the seat platform 12 is completely unfolded and the child's weight is supported by the spring force of spring 24. The spring force of spring 24 and the child's weight force are in balance so that the spring mechanism 18 is in dynamic balance in the completely unfolded position of the seat platform 12, i.e., if, e.g., the child exerts additional force in this state (e.g. by seesawing on the seat platform 12), the spring mechanism 18 is capable of further extension/compression and, hence, compensates that additional force dynamically. If the child wants to stand up, e.g. after a rest period, the seat platform 12 is biased towards the frame 14 so that the transition from the seating position to the standing position is exclusively supported by spring force of strong spring 24 (relative to springs 20 and 22), i.e. the child does not have to lift his/her complete weight when standing up. The folding operation of the seat platform 12 is performed in reverse order.

In this embodiment, the spring loading travel blocking devices 26-1 and 26-2 may be adjustable in their length/position to thereby change the force required to shunt out the corresponding spring. Furthermore, if required, the seat platform 12 may abut against the frame 14 so as to function as a spring unloading travel blocking device (e.g. also for spring 24). Furthermore, if required for preloading of the spring mechanism, spring unloading travel blocking devices may be implemented in an analogous manner as in the compression type spring mechanism. An additional damping element, e.g. a speed control damper, may be mounted between the seat platform 12 and the frame 14 to slow down the speed of the seat platform folding operation to a desired level so as to prevent snapping back of the seat platform 12 towards the frame 14.

As a further preferred embodiment, the assistive walker device 16 is provided with the seat device 10 having the spring mechanism of the extension type described above (cf. FIGS. 5 and 6). Here, the assistive walker device 16 remains the same as described with regard to FIG. 3 with exception of the spring mechanisms 18, which are of the extension type; i.e., the spring mechanisms 18 are e.g. directly connected between the frame 14 and the seat platform 12 in a manner so as to pull/bias the seat platform 12 towards the frame 14 or are e.g. provided to exert a pulling/biasing force on the belts 48 connected with the seat platform 12.

Various embodiments are defined by the following numbered examples.

Example 1 is a seat device, comprising a frame, a seat platform which is hinged to the frame so as to be pivotable between a completely folded position and a completely unfolded position, in which a user is allowed to seat thereon, and a spring mechanism with a variable overall spring constant, via which the seat platform is connected to the frame in a manner so as to be biased towards its folded position, thereby reducing an effort required by the user, who seats on the seat platform, for standing up therefrom, wherein the spring mechanism comprises a plurality of spring devices, each of which has an at least substantially constant spring characteristic which is at least substantially defined by a corresponding spring constant, and which are connected to each other in series, wherein the spring mechanism is provided such that, when the seat platform is at least substantially in its completely folded position, the variable overall spring constant is lower than in the case when the seat platform is at least substantially in its completely unfolded position, and wherein, when the seat platform is in its completely unfolded position, the overall spring constant is defined by the spring constants of only a fraction of the plurality of spring devices.

In Example 2, the subject matter of Example 1 may further include that the spring devices comprise respectively different spring constants.

In Example 3, the subject matter of Example 2 may further include that when the seat platform is at least substantially in its completely folded position, the variable overall spring constant is defined by at least that spring device which has the lowest spring constant.

In Example 4, the subject matter of Example 2 or 3 may further include that when the seat platform is at least substantially in its completely unfolded position, the variable overall spring constant is exclusively defined by that spring device which has the largest spring constant.

In Example 5, the subject matter of any one of Examples 1 to 4 may further include that each of the spring devices is formed by an individual spring element.

In Example 6, the subject matter of Example 5 may further include that the individual spring element is selected from a group comprising a linear coil spring, a torsion spring, an air spring and a rubber spring element.

In Example 7, the subject matter of any one of Examples 1 to 6 may further include that the spring devices are selected from a group comprising pressure spring devices, tension spring devices and combinations thereof.

In Example 8, the subject matter of any one of Examples 1 to 7 may further include that the at least substantially completely unfolded position of the seat platform the variable overall spring constant is defined by only one of the plurality of spring devices.

In Example 9, the subject matter of any one of Examples 1 to 8 may further include that the at least substantially completely folded position of the seat platform the variable overall spring constant is defined by the spring constants of a majority or all of the plurality spring devices.

In Example 10, the subject matter of any one of Examples 1 to 9 may further include that the spring mechanism is provided such that at any intermediate position between the completely folded and unfolded positions of the seat platform the variable overall spring constant is larger than in the case when the seat platform is at least substantially in its completely folded position and is lower than in the case when the seat platform is at least substantially in its completely unfolded position.

In Example 11, the subject matter of any one of Examples 1 to 10 may further include that the spring mechanism is connected to the seat platform by means of a flexible cable.

In Example 12, the subject matter of any one of Examples 1 to 11 may further include that one or more of the plurality of spring devices includes a spring loading travel blocking device for blocking spring travel of the corresponding spring device in a spring loading direction so as to limit the spring travel of the corresponding spring device in the spring loading direction to a predetermined spring loading travel limit, wherein, when the said spring loading travel limit is reached, the spring constant of that spring device, the spring loading travel of which is blocked, is then excluded from defining the variable overall spring constant.

In Example 13, the subject matter of Example 12 may further include that the spring loading travel blocking device is adjustable so as to allow adjustment of the spring loading travel limit.

In Example 14, the subject matter of any one of Examples 1 to 13 may further include that one or more of the plurality of spring devices includes a spring unloading travel blocking device for blocking spring travel of the corresponding spring device in a spring unloading direction so as to limit the spring travel of the corresponding spring device in the spring unloading direction to a predetermined spring unloading travel limit, wherein, when the said spring unloading travel limit is reached the spring constant of that spring device, the spring unloading travel of which is blocked, is then excluded from defining the variable overall spring constant.

In Example 15, the subject matter of Example 14 may further include that the spring unloading travel blocking device is adjustable so as to allow adjustment of the spring unloading travel limit.

In Example 16, the subject matter of any one of Examples 1 to 15 may further include that at least one of the plurality of spring devices includes an adjustable spring preloading device for preloading the respective spring device in the spring unloading direction with a predetermined force so as to adjust the spring mechanism to different weights of different users.

In Example 17, the subject matter of any one of Examples 1 to 16 may further include that the frame comprises a back rest.

In Example 18, the subject matter of Example 17 may further include that the seat platform is provided so as to abut against the back rest in the completely folded position.

In Example 19, the subject matter of any one of Examples 1 to 18 may further include that the frame comprises lateral frame portions which are arranged in a lateral distance from each other so as to leave an intermediate space therebetween, in which a user can stay, wherein the seat platform is arranged such as to at least substantially horizontally extend into the intermediate space, when being in its completely unfolded position, so as to allow the user to seat thereon, and to be folded out of the intermediate space, when being in its completely folded position, so as to allow the user to stand in the intermediate space at least without substantial interference with the seat platform, and wherein each of the lateral frame portions is provided with an upper rest portion, which can be gripped by the user standing in the intermediate space to thereby allow the user to support himself thereon with its arms during standing.

In Example 20, the subject matter of any one of Examples 1 to 19 may further include that the frame comprises a rear frame portion, to which the seat platform is hinged.

In Example 21, the subject matter of any one of Examples 1 to 20 may further include that the frame is provided with wheels allowing the seat device to be moved in a rolling manner.

Example 22 is an assistive walker device comprising a seat device according to any one of Examples 1 to 21.

While the invention has been particularly shown and described with reference to specific embodiments, it should be understood by those skilled in the art that various changes in form and detail may be made therein without departing from the scope of the invention as defined by the appended claims. The scope of the invention is thus indicated by the appended claims and all changes which come within the meaning and range of equivalency of the claims are therefore intended to be embraced.

The invention claimed is:

1. Seat device, comprising:

a frame, a seat platform which is hinged to the frame so as to be pivotable between a completely folded position and a completely unfolded position, in which a user is allowed to seat thereon, and a spring mechanism with a variable overall spring constant, via which the seat platform is connected to the frame in a manner so as to be biased towards its folded position, thereby reducing an effort required by the user, who seats on the seat platform, for standing up therefrom, wherein the spring mechanism comprises a plurality of spring devices, each of which has an at least substantially constant spring characteristic which is at least substantially defined by a corresponding spring constant, and which are connected to each other in series, wherein the spring mechanism is provided such that, when the seat platform is at least substantially in its completely folded position, the variable overall spring constant is lower than in the case when the seat platform is at least substantially in its completely unfolded position, and wherein, when the seat platform is in its completely unfolded position, the overall spring constant is defined by the spring constants of only a fraction of the plurality of spring devices.

2. The seat device according to claim 1, wherein the spring devices comprise respectively different spring constants.

3. The seat device according to claim 2, wherein, when the seat platform is at least substantially in its completely folded position, the variable overall spring constant is defined by at least that spring device which has the lowest spring constant.

4. The seat device according to claim 2, wherein, when the seat platform is at least substantially in its completely unfolded position, the variable overall spring constant is exclusively defined by that spring device which has the largest spring constant.

5. The seat device according to claim 1, wherein each of the spring devices is formed by an individual spring element.

6. The seat device according to claim 1, wherein in the at least substantially completely unfolded position of the seat platform the variable overall spring constant is defined by only one of the plurality of spring devices.

7. The seat device according to claim 1, wherein in the at least substantially completely folded position of the seat platform the variable overall spring constant is defined by the spring constants of a majority or all of the plurality spring devices.

8. The seat device according to claim 1, wherein the spring mechanism is provided such that at any intermediate position between the completely folded and unfolded positions of the seat platform the variable overall spring constant is larger than in the case when the seat platform is at least substantially in its completely folded position and is lower than in the case when the seat platform is at least substantially in its completely unfolded position.

9. The seat device according to claim 1, wherein the spring mechanism is connected to the seat platform by means of a flexible cable.

10. The seat device according to claim 1, wherein one or more of the plurality of spring devices includes a spring loading travel blocking device for blocking spring travel of the corresponding spring device in a spring loading direction so as to limit the spring travel of the corresponding spring device in the spring loading direction to a predetermined spring loading travel limit, wherein, when the said spring loading travel limit is reached, the spring constant of that spring device, the spring loading travel of which is blocked, is then excluded from defining the variable overall spring constant.

11. The seat device according to claim 10, wherein the spring loading travel blocking device is adjustable so as to allow adjustment of the spring loading travel limit.

12. The seat device according to claim 1, wherein one or more of the plurality of spring devices includes a spring unloading travel blocking device for blocking spring travel of the corresponding spring device in a spring unloading direction so as to limit the spring travel of the corresponding spring device in the spring unloading direction to a predetermined spring unloading travel limit, wherein, when the said spring unloading travel limit is reached the spring constant of that spring device, the spring unloading travel of which is blocked, is then excluded from defining the variable overall spring constant.

13. The seat device according to claim 12, wherein the spring unloading travel blocking device is adjustable so as to allow adjustment of the spring unloading travel limit.

14. The seat device according to claim 1, wherein at least one of the plurality of spring devices includes an adjustable spring preloading device for preloading the respective spring device in the spring unloading direction with a predetermined force so as to adjust the spring mechanism to different weights of different users.

15. The seat device according to claim 1, wherein the frame comprises a back rest.

16. The seat device according to claim 15, wherein the seat platform is provided so as to abut against the back rest in the completely folded position.

17. The seat device according to claim 1, wherein the frame comprises lateral frame portions which are arranged in a lateral distance from each other so as to leave an intermediate space therebetween, in which a user can stay, wherein the seat platform is arranged such as to at least substantially horizontally extend into the intermediate space, when being in its completely unfolded position, so as to allow the user to seat thereon, and to be folded out of the intermediate space, when being in its completely folded position, so as to allow the user to stand in the intermediate space at least without substantial interference with the seat platform, and wherein each of the lateral frame portions is provided with an upper rest portion, which can be gripped by the user standing in the intermediate space to thereby allow the user to support himself thereon with its arms during standing.

18. The seat device according to claim 1, wherein the frame comprises a rear frame portion, to which the seat platform is hinged.

19. The seat device according to claim 1, wherein the frame is provided with wheels allowing the seat device to be moved in a rolling manner.

20. An assistive walker device comprising a seat device, the seat device comprises:

a frame, a seat platform which is hinged to the frame so as to be pivotable between a completely folded position and a completely unfolded position, in which a user is allowed to seat thereon, and a spring mechanism with a variable overall spring constant, via which the seat platform is connected to the frame in a manner so as to be biased towards its folded position, thereby reducing an effort required by the user, who seats on the seat platform, for standing up therefrom, wherein the spring mechanism comprises a plurality of spring devices, each of which has an at least substantially constant spring characteristic which is at least substantially defined by a corresponding spring constant, and which are connected to each other in series, wherein the spring mechanism is provided such that, when the seat platform is at least substantially in its completely folded position, the variable overall spring constant is lower than in the case when the seat platform is at least substantially in its completely unfolded position, and wherein, when the seat platform is in its completely unfolded position, the overall spring constant is defined by the spring constants of only a fraction of the plurality of spring devices.

* * * * *